United States Patent [19]

Bruning et al.

[11] Patent Number: 4,717,376

[45] Date of Patent: Jan. 5, 1988

[54] CENTRIFUGE WITH A SELF-EMPTYING DRUM

[75] Inventors: Paul Bruning; Willi Niemerg, both of Oelde, Fed. Rep. of Germany

[73] Assignee: Westfalia Separator AG, Oelde, Fed. Rep. of Germany

[21] Appl. No.: 881,883

[22] Filed: Jul. 3, 1986

[30] Foreign Application Priority Data

Jul. 11, 1985 [DE] Fed. Rep. of Germany ..... 3524731

[51] Int. Cl.[4] ..... B04B 3/08

[52] U.S. Cl. ..... 494/40; 494/29

[58] Field of Search ..... 494/40, 41, 42, 30, 494/38, 56, 29, 210/781

[56] References Cited

U.S. PATENT DOCUMENTS

| | | | |
|---|---|---|---|
| 3,940,056 | 2/1976 | Schmidt | 494/40 |
| 4,410,319 | 10/1983 | Zettier | 494/29 |
| 4,498,897 | 2/1985 | Günnewig | 494/27 |
| 4,614,598 | 9/1986 | Zettier | 210/781 |

FOREIGN PATENT DOCUMENTS

| | | | |
|---|---|---|---|
| 646702 | 10/1962 | Italy | 233/20 |
| 1197276 | 7/1970 | United Kingdom | 494/29 |
| 2072055 | 9/1981 | United Kingdom | 494/40 |

*Primary Examiner*—Robert W. Jenkins

*Attorney, Agent, or Firm*—Sprung Horn Kramer & Woods

[57] ABSTRACT

The centrifuge has a self-emptying drum. The jacket of the drum has expulsion apertures that lead from the solids space and that can be closed off by a piston slide. With the piston slide is associated a closure chamber. The closure chamber has channels for supplying closure liquid and communicates through a let-off channel in the form of an annular gap with a chamber. The inside diameter of the chamber equals the outside diameter of the closure chamber. The chamber can accommodate all the closure liquid in the closure chamber. This makes it possible to completely empty the closure chamber, so that there is no residual closure force on the piston slide.

3 Claims, 2 Drawing Figures

CENTRIFUGE WITH A SELF-EMPTYING DRUM

BACKGROUND OF THE INVENTION

The present invention relates to a centrifuge with a self-emptying drum, the jacket of which has expulsion apertures that lead from a solids space and that can be closed off by means of a piston slide, with which is associated a closure chamber that has channels for supplying closure liquid and that communicates through a let-off channel in the form of an annular gap with a chamber that can accommodate all of the closure liquid and through which let-off bores with constrictions extend from the jacket of the drum, whereby the annular gap can be closed off by means of a hydraulically controlled valve body that has a valve gap.

The annular gap in known centrifuge drums of this type, i.e. that discloses in German Patent Application No. P 35 09 139.8, is positioned between the outer surface of the valve body and the inner surface, concentric thereto, of the bottom of the drum. The gap can be closed off by means of a sealing site that projects radially inwardly below the gap. The closure chamber, which is below the piston slide, can empty only as far as the inside diameter of the sealing site, and closure liquid remains in the closure chamber, exerting residual closing force on the piston slide. This residual force results, when the drum is to be completely emptied, in the piston slide returning to its closure position upon termination of the emptying process. It is, however, frequently desirable to subject the drum to a rinsing agent subsequent to emptying, with the piston slide remaining in the opening position, to rinse out residual solids.

SUMMARY OF THE INVENTION

The object of the present invention is to improve the known centrifuge drum to the extent that the piston slide will remain in the opening position after it has completely emptied itself.

This object is attained through an improvement wherein the annular gap and the valve gap are between the upper surface of the valve body and the lower surface of the piston slide, and the inside diameter of the chamber is as long as or longer than the outside diameter of the closure chamber.

The special position of the valve gap and annular gap allows the inner surface of the wall of the chamber to be as large as or larger than the outside diameter of the piston slide, so that no residual closure force will be exerted on the piston slide even when the chamber is completely full.

The outer surface of the valve body in one embodiment of the invention actually constitutes the inner surface of the wall of the chamber. The resulting chamber is very inexpensive to manufacture in the form of an annular recess in the wall of the bottom of the drum.

The closing-water chamber in the valve body in one practical embodiment of the invention communicates with a hydraulically activated piston valve through a channel. Thus, the valve body can be moved very rapidly by letting closure liquid out of the closing-water chamber.

Some preferred embodiments of the invention will now be described with reference to the attached drawings, wherein:

DETAILED DESCRIPTION OF THE PREFERRED EMBODIMENTS

Figure 1:
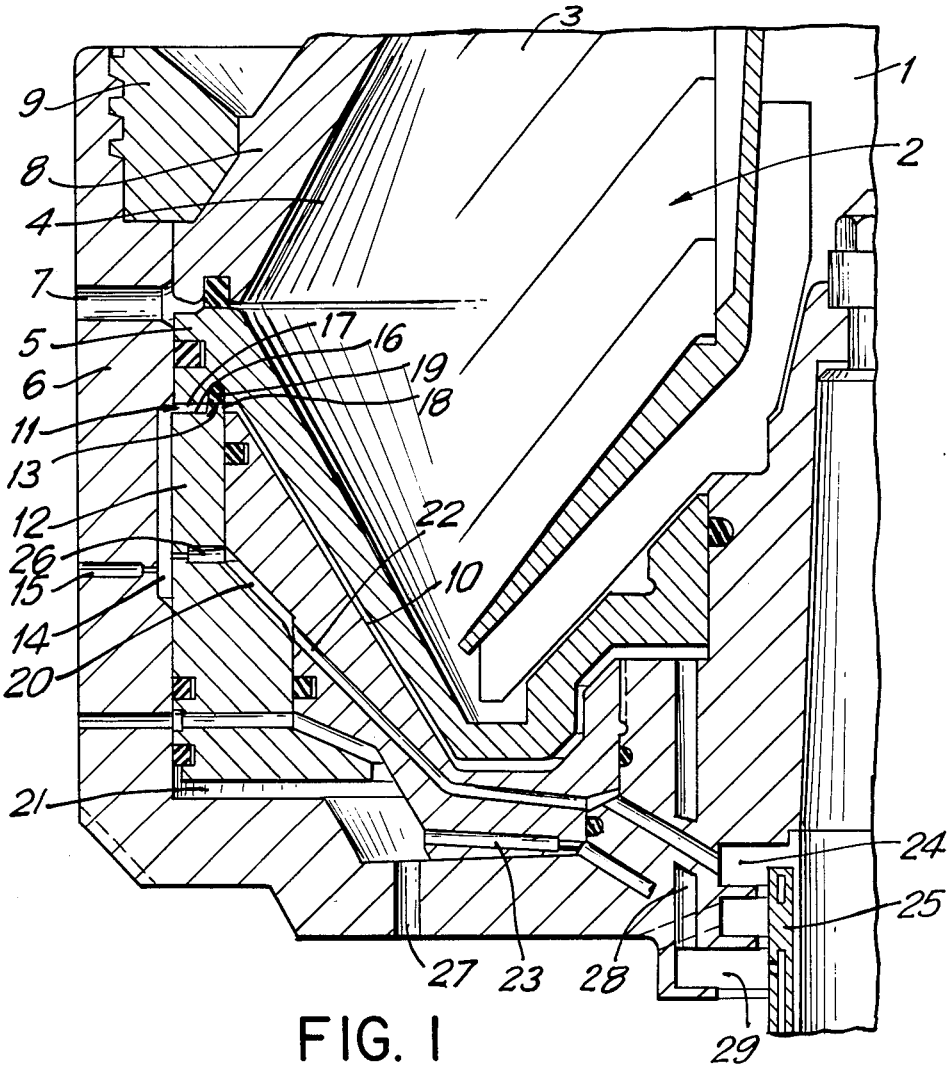
FIG. 1 is a partial section through a centrifuge drum without a piston valve and in accordance with the parent invention.

Referring now to FIG. 1, the material to be centrifuged is supplied to a centrifuging space 2 that consists of a separation space 3 and of a solids space 4 through a central inlet 1. Solids space 4 is demarcated on one side by a piston slide 5 that, as it slides up and down axially, opens and closes solids-expulsion apertures 7 in the bottom 6 of the drum. The drum also has a cover 8 secured to bottom 6 with a sealing ring 9. Below piston slide 5 is a closure chamber 10 that can be charged with closing liquid and that communicates with a chamber 14 through an annular gap 11 and a valve gap 13. Valve gap 13 can be closed off by means of a valve body 12. Let-off bores 15 extend out through the bottom 6 of the drum from chamber 14. Each let-off bore 15 has a constriction in it. Annular gap 11 is demarcated by the upper surface 16 of valve body 12 and by the lower surface 17 of piston slide 5, and valve gap 13 by a lip 18 on the upper surface 16 of valve body 12 and by a seal 19 on the lower surface 17 of piston slide 5. Associated with valve body 12 are an opening-water chamber 20 and a closing-water chamber 21 that can be charged with control water from a supply line 25 through channels 22 and 23 and an interception chamber 24. A calibrated channel 26 leads into chamber 14 from opening-water chamber 20. Closing-water chamber 21 has an overflow channel 27. Closure chamber 10 also communicates with control-water supply line 25 through a channel 28 and another interception chamber 29.

Before the material to be centrifuged is supplied to inlet 1, closure chamber 10 is filled with closing water through channel 28, interception chamber 29, and control-water supply line 25, forcing piston slide 5 into the closure position.

To initiate complete emptying, opening-water chamber 20 is charged with control water through channel 22 and interception chamber 24, forcing valve body 12 down and opening valve gap 13. The closing water now flows rapidly out of closure chamber 10 and into chamber 14, upon which the pressure in closure chamber 10 suddenly breaks down. The liquid pressure in separation space 3 and in solids space 4 forces piston slide 5 just as rapidly into its opening position, and the drum contents are competely extracted. Since chamber 14 can accommodate all the closure liquid in closure chamber 10, piston slide 5 will remain in the opening position until, once the supply of control water to opening-water chamber 20 has been discontinued accompanied by the simultaneous supply of control water to closure chamber 10, valve body 12 closes off valve gap 13 and closure chamber 10 fills up again. If, in what is known as partial emptying, only the solids are extracted, chamber 14 can be partly filled with liquid by supplying opening water at a reduced flow through channel 26 before the emptying actually occurs, to the extent that only part of the closing liquid can be removed from closure chamber 10. The opening action of piston slide 5 will accordingly be terminated sooner. Once valve gap 13 has been closed, chamber 14 will empty through let-off bores 15.

Figure 2:
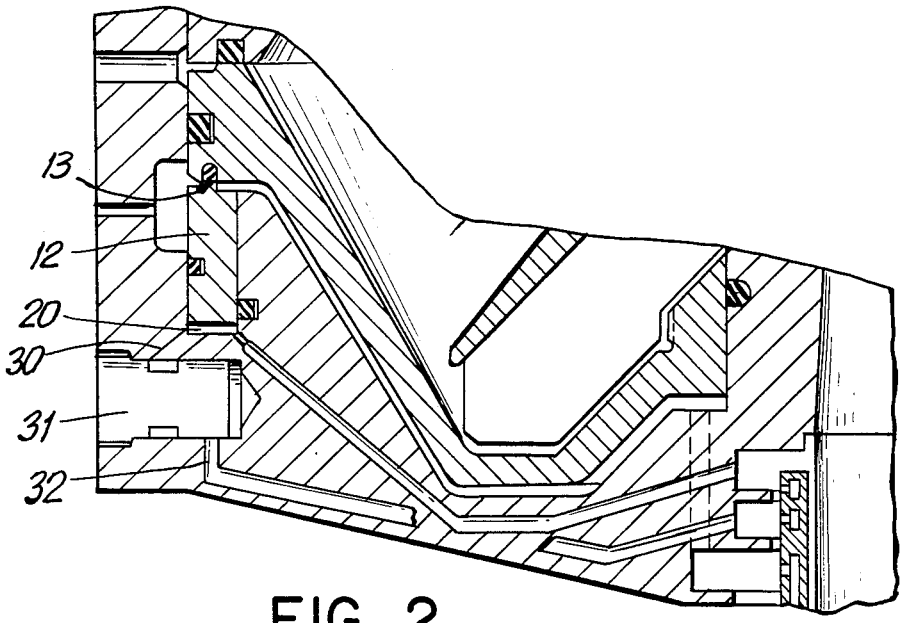
FIG. 2 is a partial section through a centrifuge drum with a piston valve and in accordance with the parent invention.

The closing-water chamber 21 in the valve body 12 in the embodiment illustrated in FIG. 2 communicates with a hydraulically activated piston valve 31 through a channel 30. To initiate the opening process, control water is supplied through channel 32 to piston valve 31, which accordingly opens. The closing water can now escape from closing-water chamber 21, and valve body 12 will be forced into its opening position by the pressure of the closing water in closure chamber 10 on the upper surface 16 of valve body 12, releasing valve gap 13. Once the supply of control water to piston valve 31 has been discontinued, accompanied by the simultaneous supply of control water to closure chamber 10 and to closing-water chamber 21, piston slide 5 will be forced back into its closure position.

It will be appreciated that the instant specification and claims are set forth by way of illustration and not limitation, and that various modifications and changes may be made without departing from the spirit and scope of the present invention.

What is claimed is:

1. In a centrifuge with a self-emptying drum having a jacket with expulsion apertures that lead from a solids space in the drum, a first axially movable piston slide for closing off the expulsion apertures, means forming a closure chamber for effecting closing movement of the piston, channels for supplying closure liquid to the chamber and a let-off channel for the closure chamber including means forming an annular gap, an annular chamber that can accommodate all of the closure liquid and let-off bores with constrictions and extending out through the jacket of the drum, a hydraulically controlled valve body for closing off the annular gap, the improvement wherein the valve body comprises a second axially movable piston slide and has means forming an annular valve gap at the periphery of the closure chamber and wherein the annular gap and the valve gap are disposed between an upper surface of the second piston slide and a lower surface of the first piston slide, and wherein the inside diameter of the annular chamber is at least as long as the outside diameter of the closure chamber.

2. The centrifuge as in claim 1, wherein an outer surface of the second piston slide constitutes the inner surface of the wall of the annular chamber.

3. The centrifuge as in claim 1, further comprising a closing-water chamber below the second piston slide and a hydraulically activated piston valve communicating with the closing-water chamber through a channel.

* * * * *